US012064021B2

(12) United States Patent
Wragg

(10) Patent No.: US 12,064,021 B2
(45) Date of Patent: Aug. 20, 2024

(54) LIP BALM DISPENSING CONTAINER

(71) Applicant: Justin Wragg, Chula Vista, CA (US)

(72) Inventor: Justin Wragg, Chula Vista, CA (US)

( * ) Notice: Subject to any disclaimer, the term of this patent is extended or adjusted under 35 U.S.C. 154(b) by 209 days.

(21) Appl. No.: 17/673,122

(22) Filed: Feb. 16, 2022

(65) Prior Publication Data

US 2022/0287438 A1 Sep. 15, 2022

Related U.S. Application Data

(60) Provisional application No. 63/159,730, filed on Mar. 11, 2021.

(51) Int. Cl.

| | |
|---|---|
| ***A45D 40/22*** | (2006.01) |
| ***A45D 40/00*** | (2006.01) |
| ***A45D 40/06*** | (2006.01) |

(52) U.S. Cl.

CPC ..... *A45D 40/221* (2013.01); *A45D 40/065* (2013.01); *A45D 2040/0025* (2013.01); *A45D 2200/05* (2013.01)

(58) Field of Classification Search

CPC ..... A45D 40/221; A45D 40/065; A45D 2200/005; A45D 2040/0025; A45D 40/00; A45D 2040/0006; A45D 2040/0031; A45D 40/22

USPC ..... 401/52, 86–88, 176, 179; 206/385

See application file for complete search history.

(56) References Cited

U.S. PATENT DOCUMENTS

| | | | | |
|---|---|---|---|---|
| 3,053,381 A * | 9/1962 | Schmid | ..... | A45D 40/22 206/823 |
| 5,944,434 A * | 8/1999 | Schlatter | ..... | A45D 40/02 401/176 |
| 7,874,753 B2 * | 1/2011 | Domy | ..... | A45D 40/10 401/109 |

* cited by examiner

*Primary Examiner* — David J Walczak

(74) *Attorney, Agent, or Firm* — Kenyon Jenckes

(57) ABSTRACT

A lip balm container, including a housing having a dial to rotate a gear to extend and retract a gear strip. The gear strip is in communication with a lip balm tube at least partially retained within the interior of the housing, wherein rotating the dial permits the extension and retraction of a lip balm disposed within the lip balm tube. A lid pivotally engaged, via a hinge, with the housing to enclose the lip balm within the housing.

4 Claims, 11 Drawing Sheets

LIP BALM DISPENSING CONTAINER

CROSS-REFERENCE TO RELATED APPLICATIONS

The present application claims priority to U.S. Provisional Patent Application No. 63/159,730 filed Mar. 11, 2021, entitled "LIP BALM DISPENSING CONTAINER," which is hereby incorporated by reference in its entirety.

TECHNICAL FIELD

Embodiments of the invention relate to topical agent dispensers and more particularly to portable lip balm containers having a lip balm dispensing mechanism.

BACKGROUND

Lip balm or lip salve is a wax-like substance applied topically to the lips to provide an occlusive layer on the lip surface to seal moisture in lips and protect the lips from external exposure. Lip balm is known to relieve symptoms associated with chapped or dry lips, angular cheilitis, stomatitis, or cold sores. Compositions of lip balm often include a wax (e.g., beeswax or carnauba wax), camphor, acetyl alcohol, lanolin, paraffin, petroleum jelly, and other ingredients. Many also contain fragrances, dyes, flavorants, sunscreen, or other compounds.

Lip balm is sold in a container, such as a cylindrical vessel having a removable lid or a dispensing tube. The tubes include a dial which allows the user to selectively protrude the lip balm from the cylindrical container to apply the tip of the lip balm onto the lips.

SUMMARY OF THE INVENTION

This summary is provided to introduce a variety of concepts in a simplified form that is disclosed further in the detailed description of the embodiments. This summary is not intended to identify key or essential inventive concepts of the claimed subject matter, nor is it intended for determining the scope of the claimed subject matter.

The embodiments provided herein relate to a lip balm container, including a housing having a dial to rotate a gear to extend and retract a gear strip. The gear strip is in communication with a lip balm tube at least partially retained within the interior of the housing, wherein rotating the dial permits the extension and retraction of a lip balm disposed within the lip balm tube. A lid pivotally engaged, via a hinge, with the housing to enclose the lip balm within the housing.

In one aspect, the lip balm container may be provided in a cylindrical configuration having a rotatable collar to extend and retract the lip balm from the container. The cylindrical configuration includes a lid which covers the interior of the container. The lip may be frictionally engaged, rotationally engaged, or otherwise able to be retained on the upper portion of the container. The collar may be disconnected from the container to allow the user to readily replace a depleted lip balm cartridge, or to exchange for a new flavor of lip balm.

The container is portable such that it may be easily carried in a pocket, backpack, handbag, purse, or the like. This allows the user to readily open the lid and extend the lip balm such that the lip balm can be applied to the user's lips. The container includes a lid which can protect the lip balm and interior components when closed, while allowing access to the lip balm when open. The container is dimensioned to receive various sizes and configurations of lip balm tubes or be used with a reusable tube to allow the user to refill the tube as needed.

The container provides a means for reducing waste attributed to the disposal of commonly used lip balm containers by utilizing a reusable lip balm container within which the lip balm cylinder is disposed. This provides a means of protecting the lip balm as well as providing a stylish means of storing, transporting, and utilizing the lip balm.

The system provides a means for protecting the lip balm from the elements while preserving ease of use during operation. The container may provide an insulative barrier while reducing waste of plastic consumables commonly associated with spent lip balm containers.

In one aspect, the container may also provide a housing having a decorative exterior. The housing may include various coloring, etching, molding, engraving, accessory components, and the like. In such, the decorative exterior provides a stylish housing. The housing may be customizable or sold as a set or kit with various interchangeable housings to allow the user to customize and/or select a decorative housing they prefer.

In one aspect, the lip balm tube is retained in position by a spring latch disposed within the housing.

In one aspect, a retainer permits the selective replacement of the lip balm.

In one aspect, the retainer slides along a top surface of the bottom of the housing.

In one aspect, the housing is reusable to allow the user to replace the lip balm once depleted.

In one aspect, the lid is retained in a closed position by a lid latch affixed to the lid and releasably engageable with the bottom of the housing.

In one aspect, the housing comprises a left side and a right side attached via a screw.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
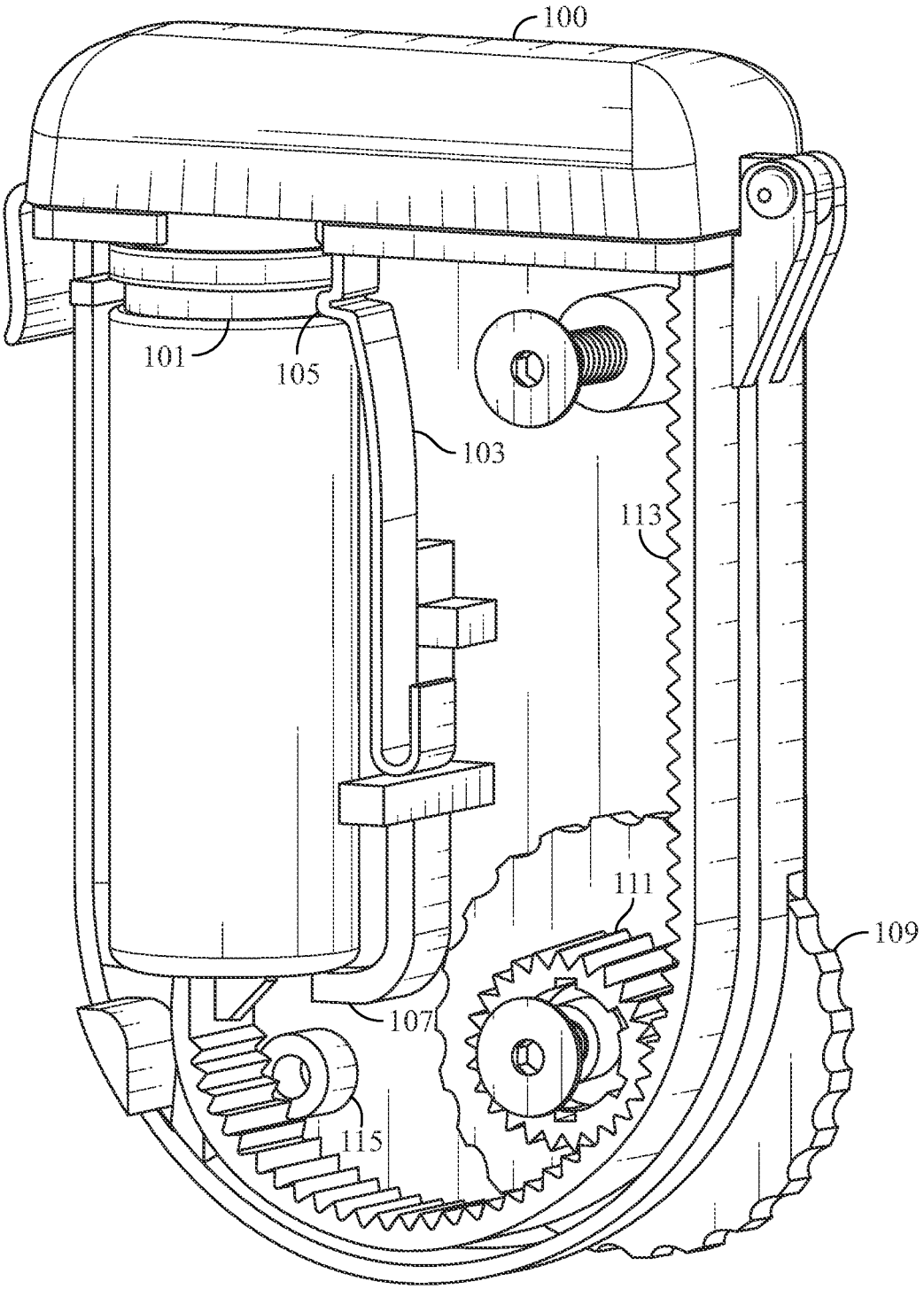
FIG. 1 illustrates a perspective view of the interior components of the lip balm dispensing container, according to some embodiments.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a lip balm container which allows the user to selectively protrude the lip balm such that the lip balm can be applied to the user's lips. The container includes a lid which can protect the lip balm and interior components when closed, while allowing access to the lip balm when open. The container is dimensioned to receive various sizes and configurations of lip balm tubes.

FIGS. 1-5 illustrate a first embodiment of the invention where FIG. 1 illustrates a perspective view of the interior components of the lip balm dispensing container 100. The container 100 is dimensioned to contain a lip balm tube 101 which contains the lip balm composition therein. The container 100 is reusable such that once the lip balm composition is used, the user can dispose another lip balm tube 101 within the container 100. The lip balm tube 101 is held in place by a spring latch 103 which retains the lip balm tube 101 between a top portion 105 and a bottom portion 107. A dial 109 having a central gear 111 affects a gear strip 113 to extend or retract the lip balm by actuating a conventional sliding piston in the lip balm tube. A ratchet post 115 maintains sufficient tension on the gear strip 113 to maintain the lip balm in position.

In some embodiments, the container may include a push-button to push the lip balm through the opening of the container. The push-button may engage the gear and/or gear strip to mechanically force the lip balm upwards while retaining the lip balm in position during use. The push-button may also be used to retract the lip balm during storage.

Figure 2:
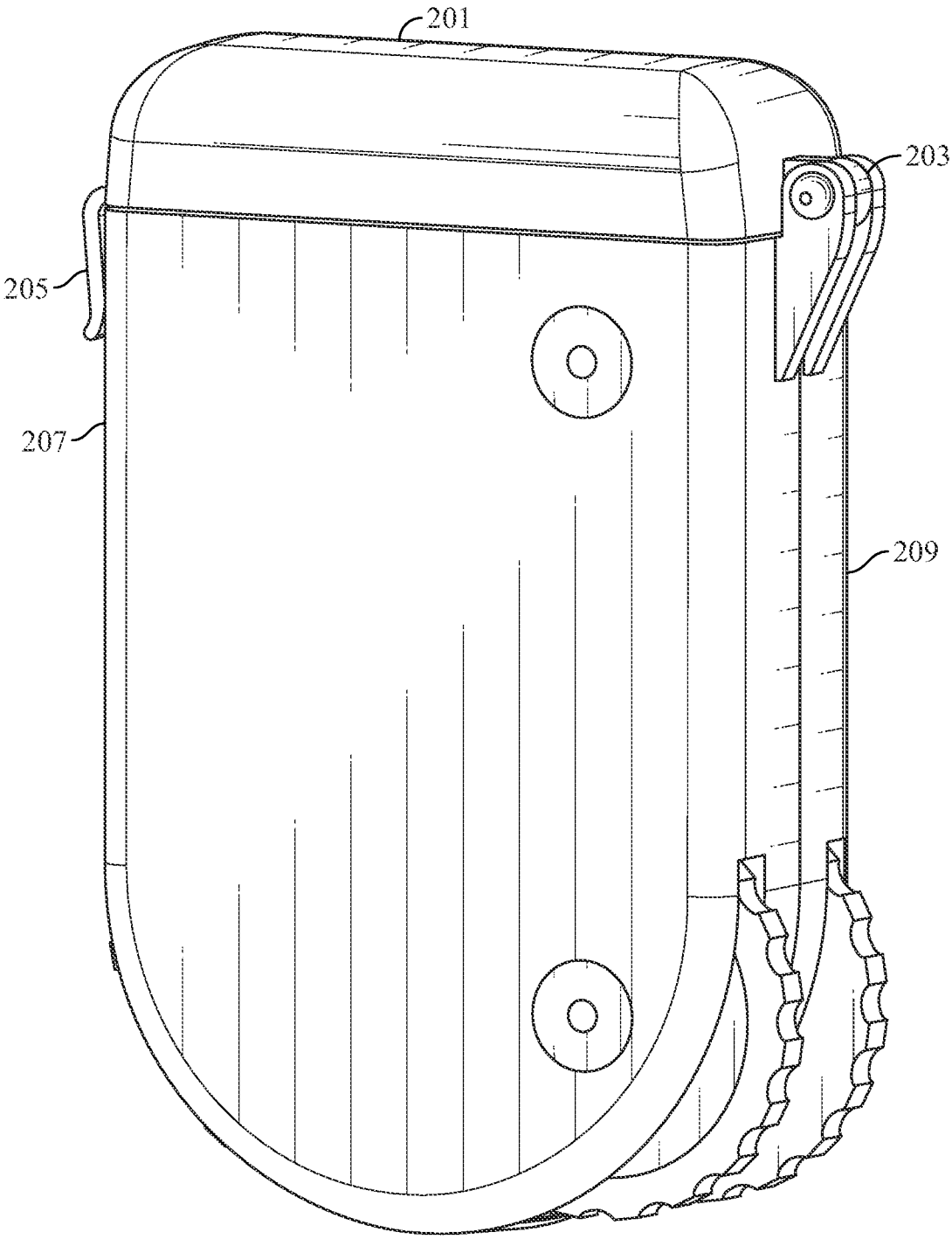
FIG. 2 illustrates a perspective view of the lip balm dispensing container, according to some embodiments.

FIG. 2 illustrates a perspective view of the lip balm dispensing container 100 wherein the lid 201 is in a closed configuration. The lid 201 pivots via a hinge 203 positioned on a side of the container 100. The lid is retained in the closed position by a lid latch 205 which releasably engaged with the bottom 207 of the housing 209. In such, the user can selectively open and close the lid 201 between periods of use and storage. The lid 201 may sealingly engage with the bottom 207 to protect the lip balm and interior components of the container 100.

Figure 3:
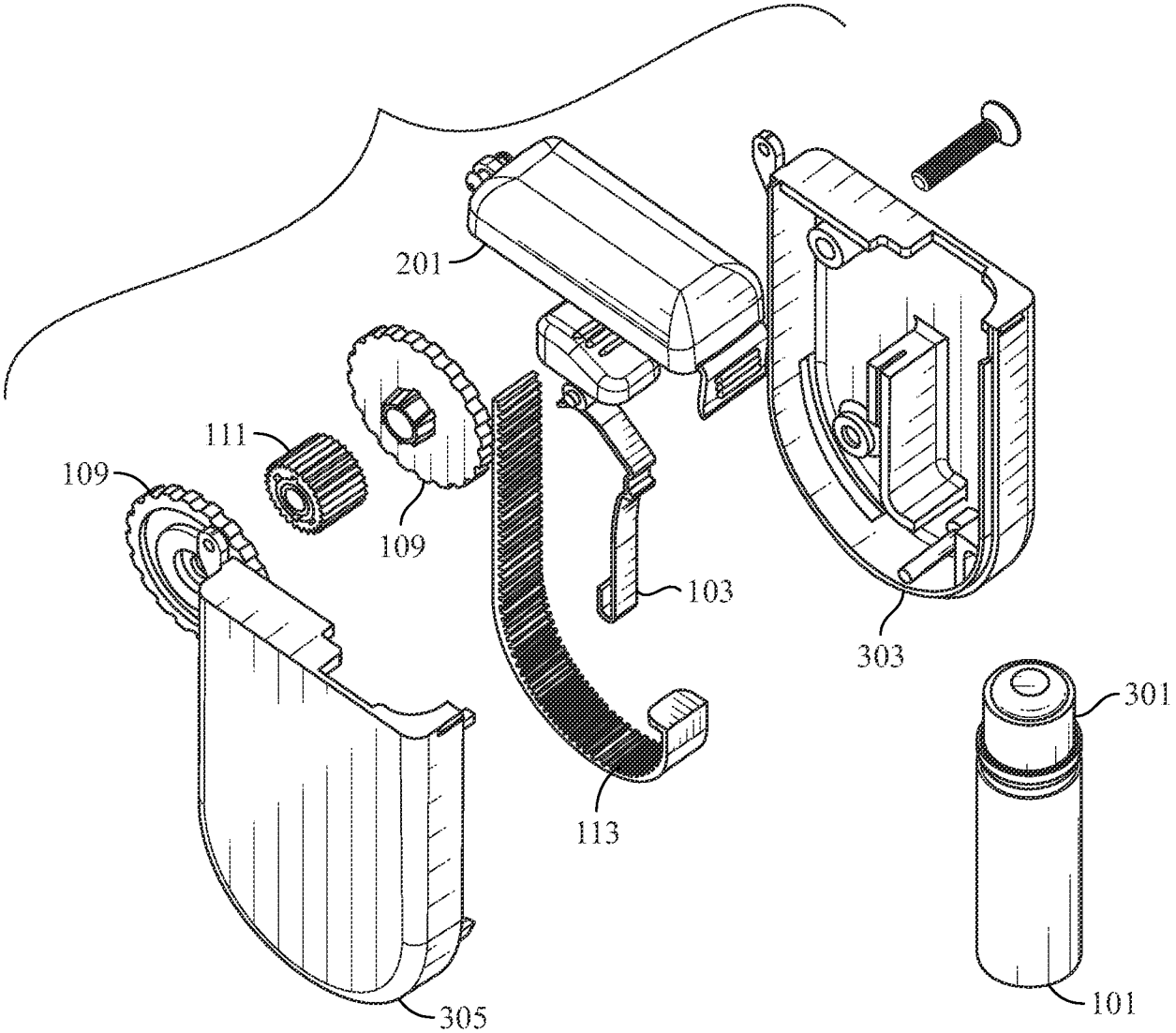
FIG. 3 illustrates an exploded view of the lip balm dispensing components and housing, according to some embodiments.

FIG. 3 illustrates an exploded view of the lip balm dispensing components and housing. The lip balm 301 is retained within the lip balm tube 101 which is stored within the housing. The housing includes a left side 303 and right side 305. The lid 201 pivotally engages with the hinge to allow the lid to open and close while joining the left and right sides 303,305 of the housing. One or more dials 109 turn the gear 111 to move the gear strip 113 to extend and retract the lip balm 301. The gear 111, gear strip 113, lip balm tube 101, and spring latch 103 are each at least partially retained within the housing. A screw 307 threadingly engages with the left side 303 and/or right side 305 of the housing to seal and permit access into the interior of the housing.

Figure 4:
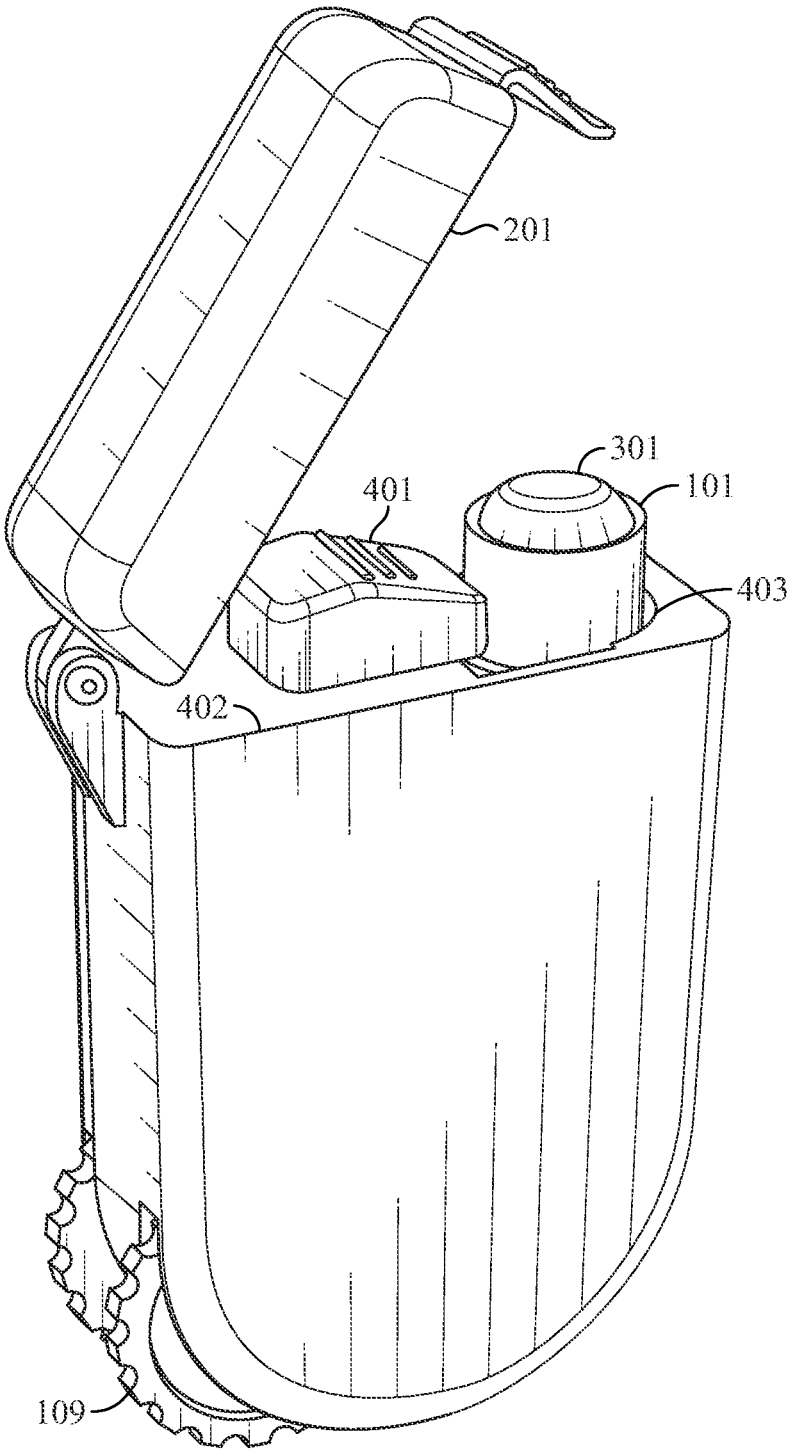
FIG. 4 illustrates a perspective view lip balm dispensing container wherein the lid is in an open configuration, according to some embodiments.

FIG. 4 illustrates a perspective view lip balm dispensing container wherein the lid 201 is in an open configuration. The lid 201 has a height sufficient to enclose a retainer 401 which maintained the lip balm tube 101 in position. The retainer 401 may slide along a top surface 402 to release the lip balm tube 101 when the lip balm 301 is depleted. This allows the user to replace the lip balm 301 and tube 101 thereof and reuse the container 100. The lip balm 301 extends and/or retracts through the lip balm tube 101 via the dial 109. The lip balm tube 101 at least partially extends through the opening 403 in the top surface 402.

Figure 5:
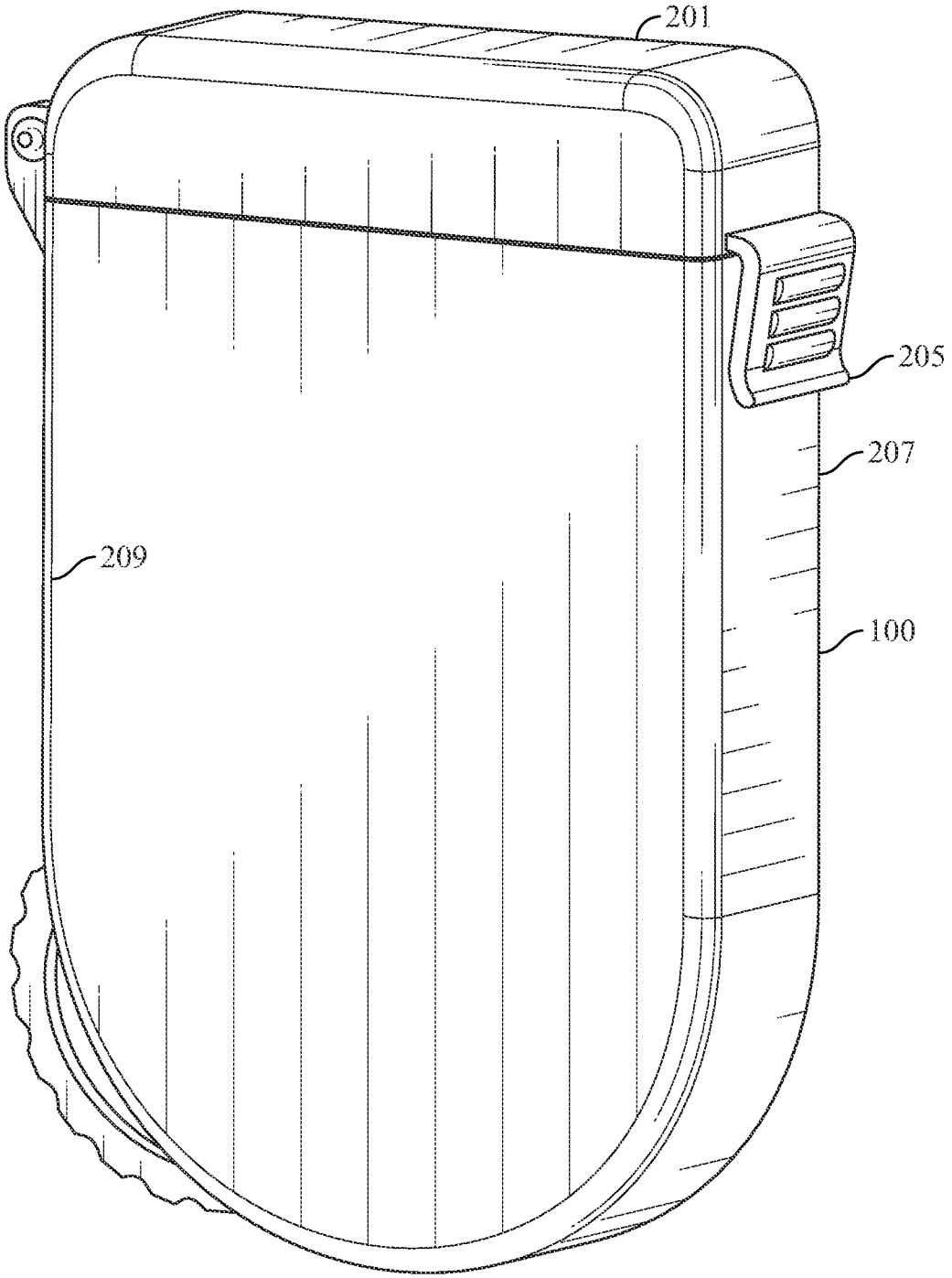
FIG. 5 illustrates a perspective view lip balm dispensing container wherein the lid is in a closed configuration, according to some embodiments.

FIG. 5 illustrates a perspective view lip balm dispensing container 100 in the closed configuration. The lid latch 205 is affixed to the lid 201 and releasably engages with a receiver on the bottom 207 of the housing 209. The lid latch 205 may be constructed of a sufficiently flexible material to bend and engage with the bottom 207. Alternatively, the lid latch 205 may include a latching mechanism to secure the lid 201 to the bottom 207 of the housing 209.

Figure 6:
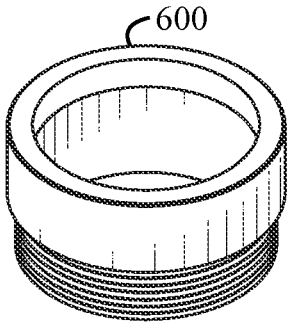
FIG. 6 illustrates a perspective view of the collar, according to some embodiments.
Figure 7:
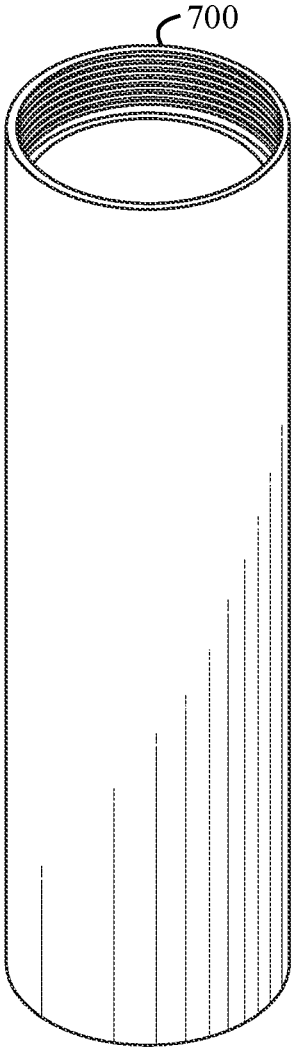
FIG. 7 illustrates a perspective view of the lip balm tube, according to some embodiments.
Figure 8:
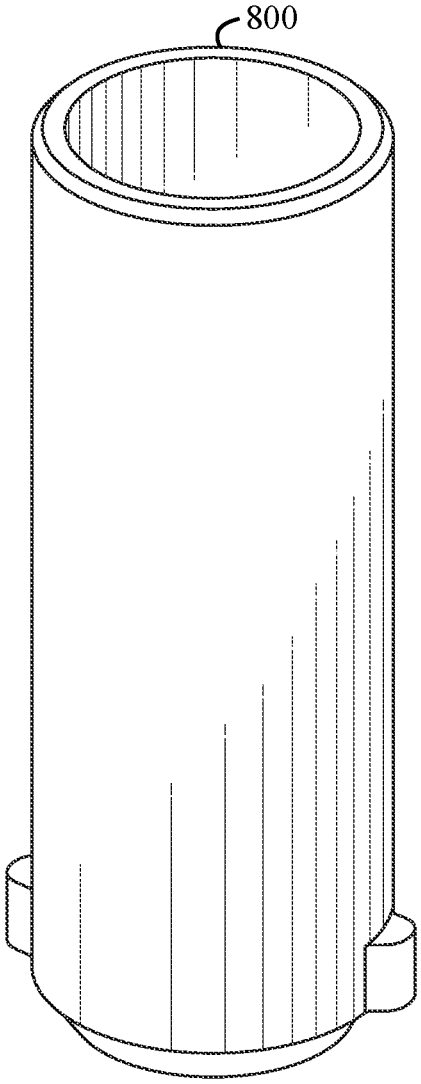
FIG. 8 illustrates a perspective view of the extruder, according to some embodiments.

FIGS. 6-17 illustrate another embodiment of the invention where FIG. 6 illustrate a perspective view of the collar 600 which rotationally engages with lip balm tube. The collar may engage with the extruder body 700 (see FIG. 7) to extend the extruder 800 (see FIG. 8) and expel the lip balm tube from the container. The collar 600, extruder body 700 and extruder 800 are each dimensioned to be concealed within the container.

Figure 9:
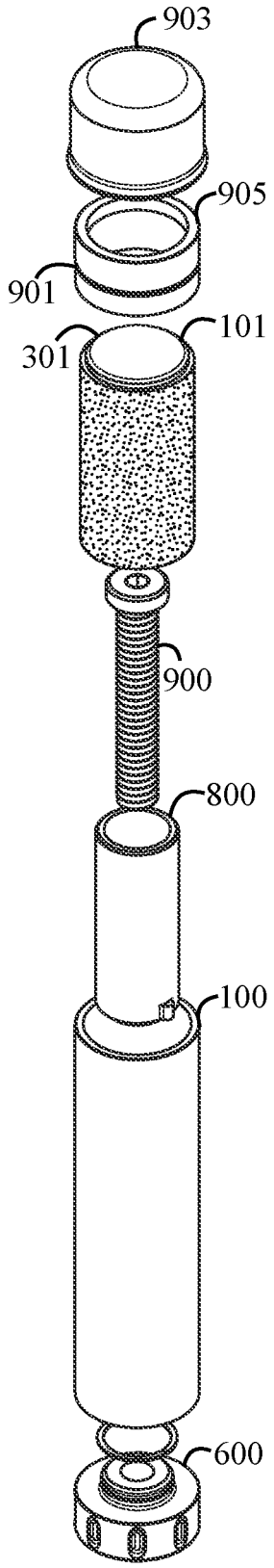
FIG. 9 illustrates an exploded view of the lip balm tube, according to some embodiments.

FIG. 9 illustrates an exploded view of the lip balm dispensing container 100 having a collar 600 wherein the collar rotates a screw 900 to extend the lip balm 301 from the container 100. The lip balm 301 is retained within the extruder body 700 and extruder 800 and is expelled therefrom once the user rotates the collar 600. A top 901 is threadingly engaged with the container 100 and allows the lip balm 301 to extend through an opening during use. A cap 903 engaged with the upper portion 905 of the container to cover the lip balm when not in use and prevent damage or contact with debris, liquids, or other contaminants.

Figure 10:
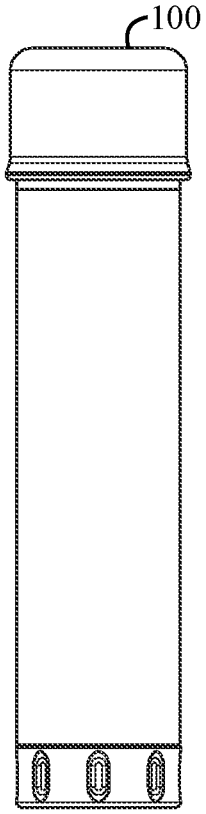
FIG. 10 illustrates a side elevation view of the lip balm tube, according to some embodiments.
Figure 11:
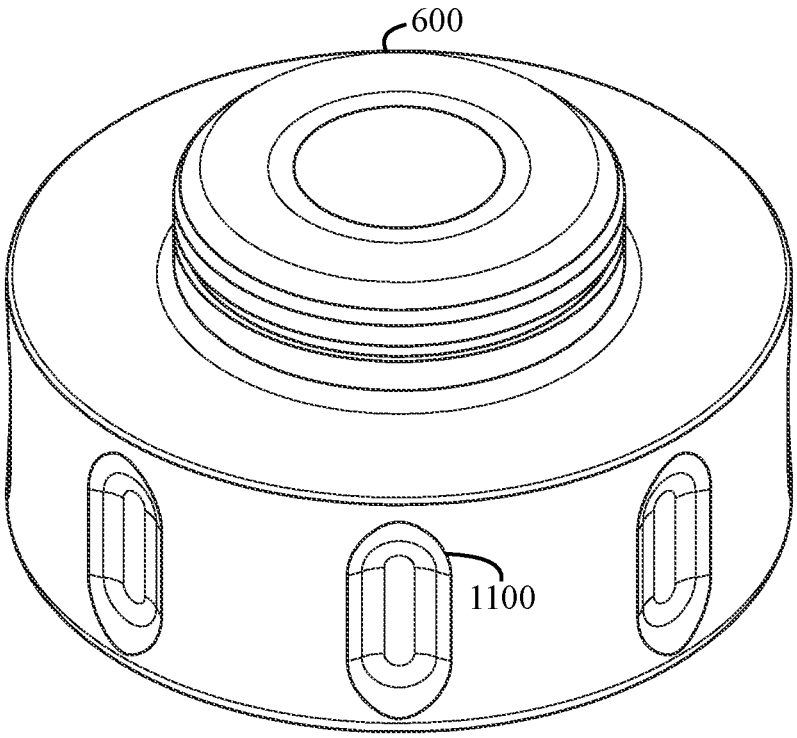
FIG. 11 illustrates a perspective view of the rotatable collar, according to some embodiments.
Figure 12:
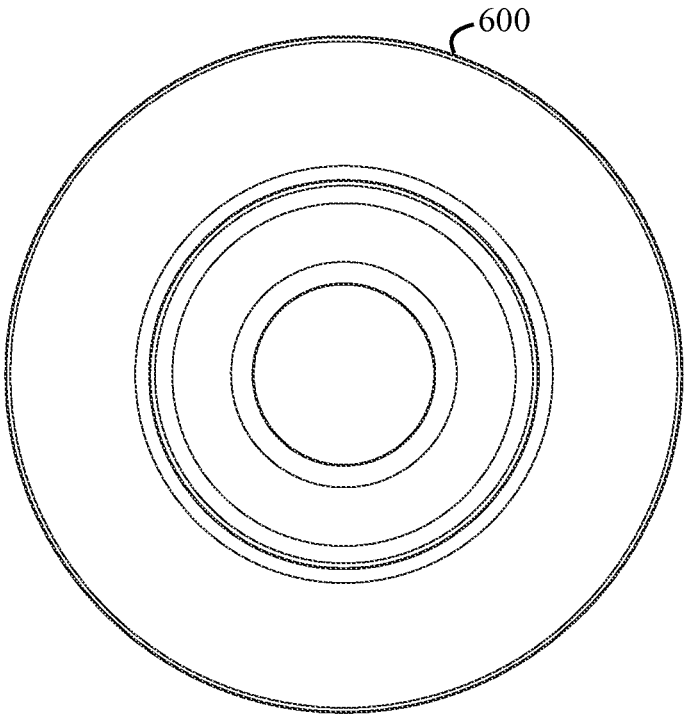
FIG. 12 illustrates a top plan view of the rotatable collar, according to some embodiments.
Figure 13:
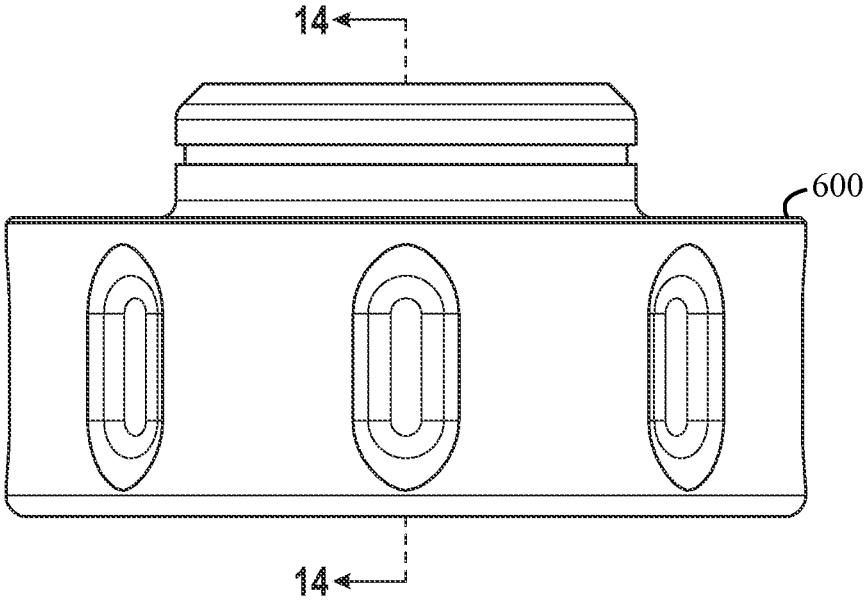
FIG. 13 illustrates a side elevation view of the rotatable collar, according to some embodiments.

FIG. 10 illustrates a side elevation view of the lip balm container 100. The embodiments allow for the lip balm to be provided as a cylinder and replaced as needed. In such, the container 100 is reusable between multiple lip balms. This may also allow the user to readily interchange lip balms as desired, while saving the unfinished lip balm for future use.

For example, the user may purchase various flavors of lip balm to allow the user to readily change between flavors as desired.

Figure 14:
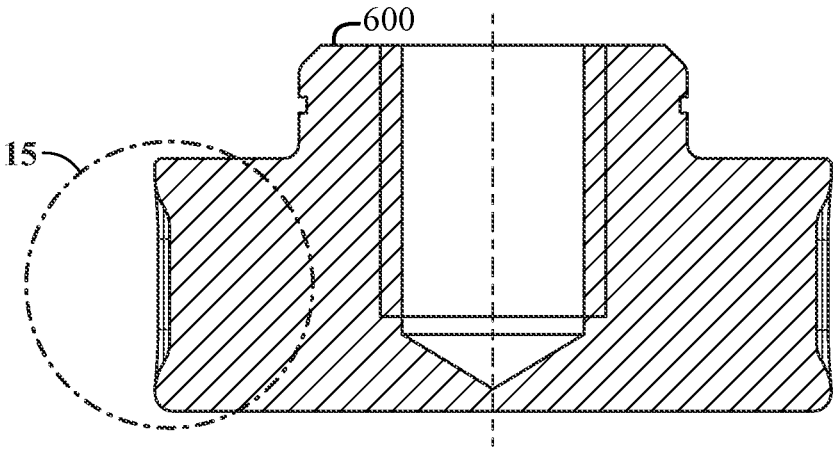
FIG. 14 illustrates a cross-section view of the rotatable collar, according to some embodiments.
Figure 15:
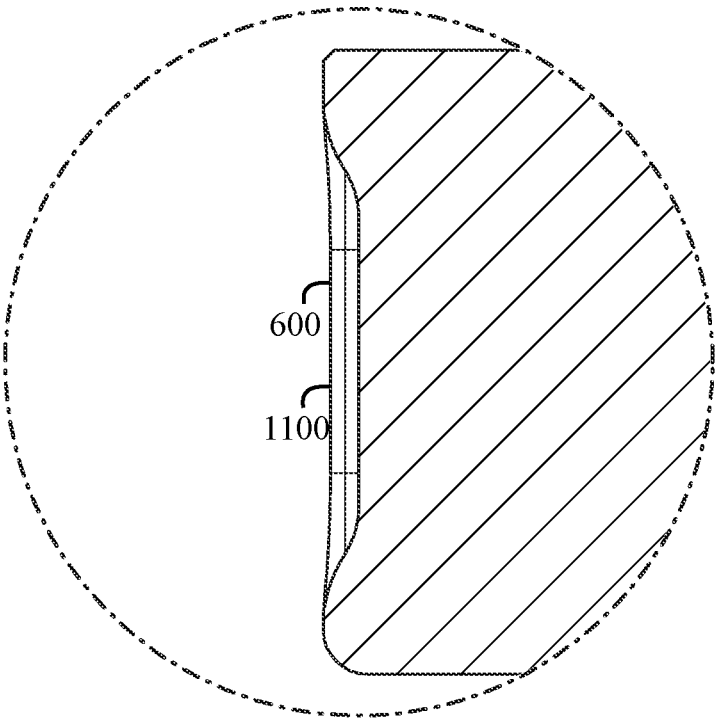
FIG. 15 illustrates a detail cross-section view of the side of the rotatable collar, according to some embodiments.

FIGS. 11-15 illustrate the collar 600 which is rotated by the user to extrude the lip balm from the lip balm tube. The collar 600 may include a plurality of radially interspaced grip portions 1100 (see FIG. 11) which aid the user in gripping the surface of the collar 600. FIGS. 14-15 illustrated a cross-section of the collar 600.

Figure 17:
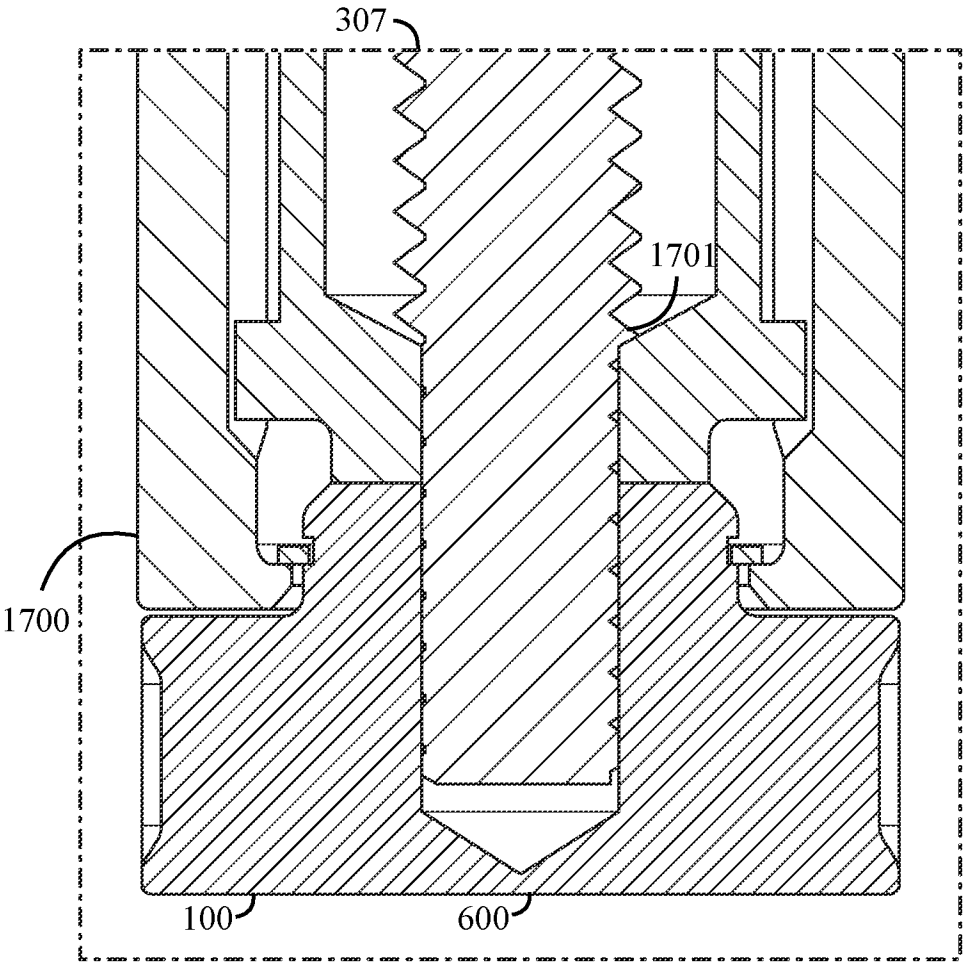
FIG. 17 illustrates a cross-section view of the bottom portion of the lip balm dispensing container, according to some embodiments.
Figure 16:
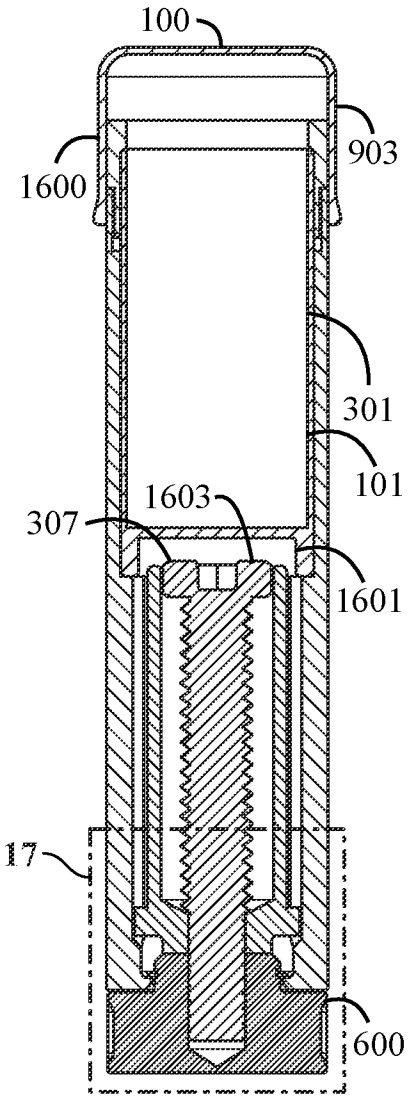
FIG. 16 illustrates a cross-section view of the lip balm dispensing container, according to some embodiments.

FIG. 16 illustrates a cross-section view of the lip balm dispensing container 100 including the cap 903 positioned at the top 1600 of the lip balm dispensing container 100. The lip balm 301 is provided within the lip balm container and disposed near most the top 1600. A plunger 1601 is provided between the lip balm tube 101 and the upper end 1603 of the screw 307. Rotating the collar 600 extends are retracts (depending on the direction of rotation) the screw 307 and thus extends or retracts the lip balm 301. FIG. 17 illustrates a cross-section view of the bottom portion 1700 of the lip balm dispensing container 100 to provide a detail view of the collar 600 and screw 307. The screw 307 is threaded through complimentary threading 1701 to allow the controlled extension and retraction of the screw 307.

During use, the user may first remove the cap from the upper portion of the lip balm container and unscrew the collar. If a depleted lip balm cartridge is within the container, the user removes the depleted cartridge and inserts a lip balm cartridge. The collar is screwed onto the container and the container is now ready for use.

In some embodiments, the container may include a reusable lip balm tube to permit the user to procure their own lip palm composition and dispose the lip balm in the reusable lip palm tube.

In some embodiments, the housing includes a decorative exterior surface. The decorative exterior surface may include coloring, etching, molding, engraving, accessory items, and combinations thereof. The decorative housing may be customizable or sold as a set or kit.

In some embodiments, the housing may be constructed of metals, metal alloys, plastic, wood, or other materials which are durable enough to withstand repeated use. Similarly, a combination of materials may be utilized, such as metal for the moving components to ensure longevity of the container and internal components thereof.

In some embodiments, the lip balm cartridge may be constructed of cardboard or similar recyclable material to reduce any waste generated by the use of lip balm with the lip balm container embodiments described herein.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A lip balm container, comprising:

a container including a spring latch configured to releasable hold a lip balm tube in a retained position, the lip balm tube including a slidable rising piston and configured to accept a lip balm composition having a cylindrical shape adapted to fit into an interior of the lip balm tube, a top surface including an opening adapted to permit the lip balm tube to be partially ejected from the container in an unretained state when the spring latch is released, a retainer on the top surface and connected to the spring latch, the retainer configured to enable a user to release the spring latch and enable the lip balm tube to move into the unretained state, and a gear strip adapted to engage the slidable piston and configured to extend or retract the lip balm when the lip balm tube is in the retained state, a dial partially exposed from a body of the container, and a central gear connected between the dial and the gear strip operative to control the gear strip to extend or retract the lip balm tube.

2. The lip balm container of claim 1, further comprising a ratchet post secured to an interior of the body of the container and configured to apply tension on the gear strip.

3. The lip balm container of claim 1, further comprising a lid positioned above the container including a releasable lid latch and a hinge.

4. The lip balm container of claim 1, wherein the lip balm tube has a shape configured to enable a user to eject the lip balm tube and replace with another lib balm tube.

* * * * *